United States Patent [19]

McArdle

[11] 4,354,333

[45] Oct. 19, 1982

[54] PACKAGING APPARATUS

[75] Inventor: Edward J. McArdle, Morton Grove, Ill.

[73] Assignee: Illinois Tool Works Inc., Chicago, Ill.

[21] Appl. No.: 140,071

[22] Filed: Apr. 14, 1980

[51] Int. Cl.[3] ..... B65B 21/18

[52] U.S. Cl. ..... 53/48; 53/534; 53/556; 53/585; 53/291

[58] Field of Search ..... 53/398, 441, 534, 556, 53/585, 291, 292, 295, 296, 297, 298, 48

[56] References Cited

U.S. PATENT DOCUMENTS

| | | | |
|---|---|---|---|
| 2,652,963 | 9/1953 | Pomeroy | 53/295 |
| 2,864,212 | 12/1958 | Bruce | 53/441 X |
| 2,978,854 | 4/1961 | Fairest | 53/534 X |
| 3,032,944 | 5/1962 | Holl | 53/556 X |
| 3,123,956 | 3/1964 | Fisher | 53/534 X |
| 3,714,756 | 2/1973 | MacInnes | 53/556 X |
| 3,816,968 | 6/1974 | Morgan | 53/556 X |
| 3,888,067 | 6/1975 | Cross | 53/296 |
| 3,906,704 | 9/1975 | Cunningham | 53/556 X |
| 3,977,150 | 8/1976 | Culpepper | 53/398 |
| 4,070,850 | 1/1978 | Cunningham | 53/48 |
| 4,072,553 | 2/1978 | Braker | 53/585 X |
| 4,237,675 | 12/1980 | Myers | 53/585 X |
| 4,284,030 | 2/1981 | Heckman | 53/556 X |
| 4,287,700 | 9/1981 | Fujio | 53/295 X |

*Primary Examiner*—John Sipos

*Attorney, Agent, or Firm*—Thomas W. Buckman

[57] ABSTRACT

Method and apparatus for multipackaging bottle-like containers as they are continuously moved through the apparatus. Continuously moving jaw stations incorporating opposing pairs of upstanding shell-like stretching members coact to continuously highly stretch a tube of thermoplastic material and release the stretching force after the plurality of bottles to be packaged are placed within the perimeter of the stretched tube.

10 Claims, 7 Drawing Figures

AAA
BBB
CCC
DDD

PACKAGING APPARATUS

BACKGROUND OF THE INVENTION

The subject invention relates generally to a method and apparatus for packaging containers which typically include a body portion and relatively small neck portion. More particularly, the invention relates to an apparatus for forming a package of the type described in Ser. No. 47,436 filed June 11, 1979, now abandoned.

Typical methods and apparatus for making multipackages have utilized a wide variety of techniques. A particularly effective technique for multipackaging can-type containers utilizes a rotating drum for continuously applying a strip stock of plastic material having a plurality of apertures over the chimes of such can-type containers as they are fed beneath the drum. Other techniques of producing a multipackage of containers involve the wrapping of paper or cardboard about the plurality of containers or the firm envelopment of a plurality of containers with a film of plastic by passing the containers to be packaged through a series of stations, including a heat shrinking applicating station where the containers are draped with the material to form the package, and then passed through an oven which heats the plastic material shrinking the same and creating a utilized package. Another technique of packaging bottle-like containers includes the use of top engaging clips snapped over the tops of the bottles to utilize the package while creating a means to handle the package.

A further manner of multipackaging bottle devices involves placing a band of plastic material about a plurality of bottles in addition to the placing of a top gripping strip of plastic over the tops to resiliently secure the tops together. A typical apparatus of this type is shown in U.S. Pat. No. 3,714,756. In this device, the array or clusters of containers to be packaged are passed beneath a series of heads which are adapted to reciprocate toward and away from the cluster to place a band about the array. After the band is associated with the array the semifinished package then is moved to a subsequent station which incorporates the top engaging carrier device. While this technique and resulting package somewhat resembles the technique of the present invention, it should be understood that such a prior art technique does involve stop and start elements of motion and requires separate stations to apply a top gripping carrier device.

SUMMARY OF THE INVENTION

The present invention contemplates the production of a package consisting of a plurality of bottle-like containers which are unitized by placing a highly stretched tube of thermoplastic material about the perimeter of the array of containers to be packaged. The invention further contemplates the continuous movement of containers through the apparatus while the various sections or stations in the apparatus are also moving continuously so that the packaging may be accomplished with a maximization of efficiency and speed.

The primary object of the invention is to provide a machine and method for placing a highly stretched tubular packaging device about an array of packages.

A further object of the invention is to provide a packaging machine and method which utilizes a continuous orbital movement of various elements of the invention contributing to the making of the package as the bottles to be packaged pass continuously through the machine, thereby maximizing speed and efficiency.

The objects and advantages of the invention are obtained by an apparatus which utilizes a pair of closed conveyor devices, each conveyor device continuously orbiting a plurality of spaced series of jaw stations. The conveyor devices are arranged so they become generally tangent to one another in an area defining the throat or longitudinal center line of the machine where laterally adjacent pairs of jaw stations move together at the same speed. Each jaw station comprises a pair of shell-like stretching members which are operatively connected to cam followers so that the stretching members are, in their closed position, positioned with the convex sides of the adjacent pairs in close proximity to one another, to permit an unstretched tube to be positioned over and around the closely, laterally spaced adjacent pairs of jaws. The stretching of the tube occurs when the cam followers, continuously moving in a cam track, pull the bases of the shell-like jaws laterally outwardly so that the jaws are therefore rotated outwardly, gradually stretching the tube with the containers positioned within the confines of the jaws. The jaws and associated linkages are designed so that the bottles to be packaged may be placed in the path of the conveyor with the jaws in their closed position and so the containers will remain in the same relative position to one another while the jaws rotate about the periphery of the containers to an open, tube stretching position. An independent conveyor timed with the movement of the packaging conveyor is provided above the path of movement of the jaws and adapted to place a series of discrete, unstretched tubes successively about a set of closed jaws. The unstretched tubes are conveyed by sets of fingers, which open the tube from a flattened configuration, to a configuration sufficient to be slid over and around the jaws.

It has been found advantageous to have the jaw stations at the lowermost elevation of the machine with the bottles to be packaged fed on a conveyor above the elevation of the jaws.

The bottles may be transported from an input conveyor down to the jaw level of the machines by two different techniques. A first technique utilizes a feeding of a discrete handle between each of the pair of bottles to be packaged and, thereafter, using this handle as a means to transport the bottles down to the lower level of the machine and into the jaw region. However, in packages which do not require a handle, a conveyor arrangement of bars having neck grasping regions can be used to transport the bottles down into the packaging area. The particular machine is designed to package two/two-liter style plastic bottles. However, it should be understood that the basic invention can be adapted for other pluralities of other bottles.

Other objects and advantages and structures of the invention will become apparent from the following description when taken in conjunction with the accompanying drawings, wherein:

GENERAL DESCRIPTION OF METHOD AND APPARATUS

Figure 1:
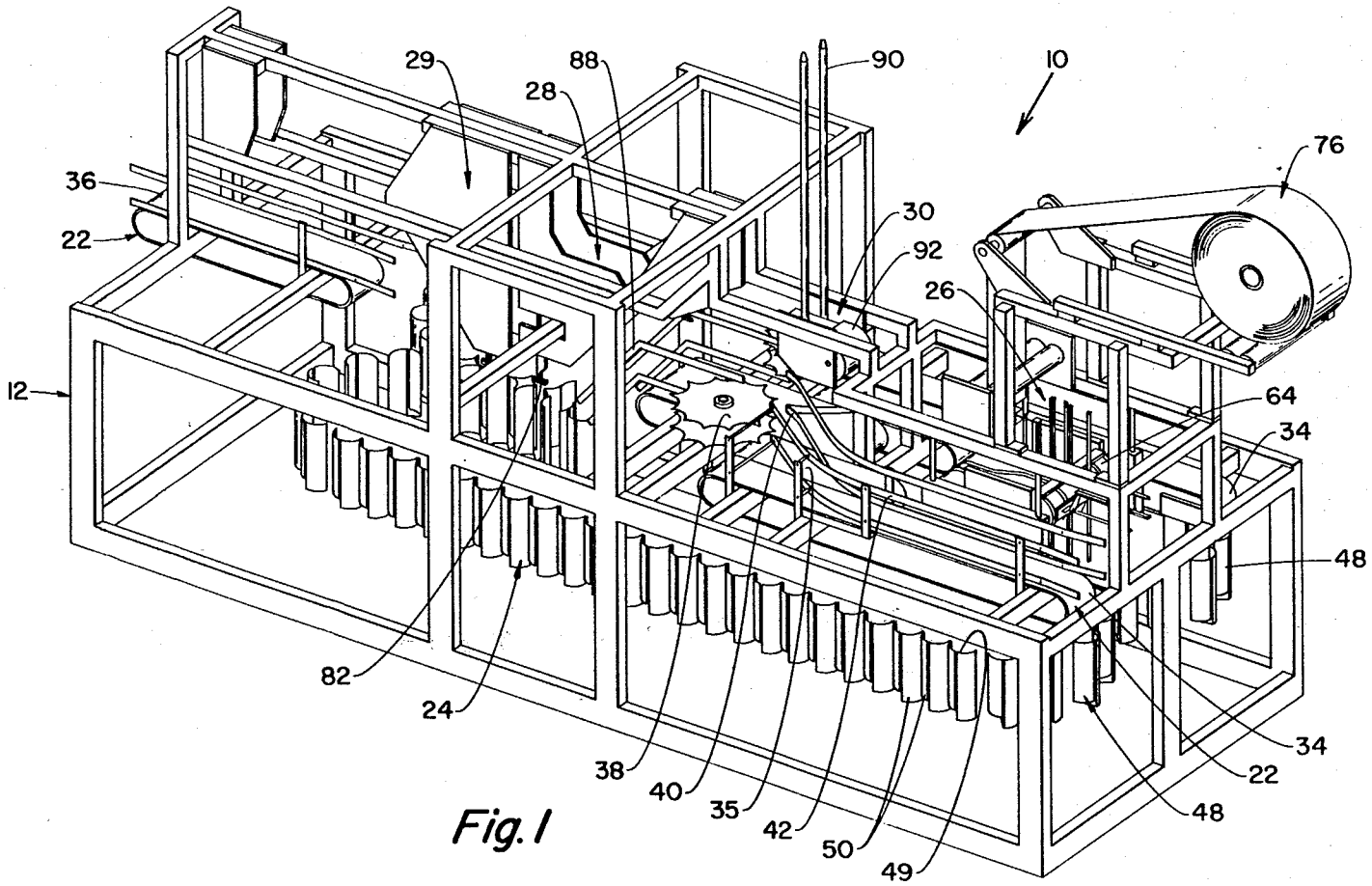
FIG. 1 is a perspective view showing the operating mechanisms of the apparatus.

The method and apparatus disclosed herein is particularly designed to produce a package of the type described in Ser. No. 47,436. Such a package is typically a pair of relatively large, two-liter plastic bottles which have been unitized by placing a band of highly stretched thermoplastic material, such as polyethylene around the sides and a portion of the tapered top portion of the pair of bottles. The apparatus 10 and method of this invention may best be described by referring to several interrelated sections of the apparatus. A frame 12 carries and integrates four such sections which are to be described as; firstly, the conveyor section 22 for feeding a plurality of discrete bottles into the packaging area and carrying a plurality of packaged bottles from the packaging area; secondly, the tube stretching and package making jaw sections 24 and; thirdly, the package making device transfer mechanism 26; and fourthly, a mechanism 28 for transferring the bottles to and from the elevation of the package making jaws.

The input and output conveyors are located at predetermined elevations which are consistent with the elevations of automated filling lines and conveyors in beverage producing plants.

The tube stretching jaws operate at an elevation below the elevation of the input and output conveyors and consist of a pair of endless conveyors designed so that a large segment of the path of each conveyor extends in a side by side closely adjacent manner generally along the center line of the machine. Each conveyor includes a group of jaw elements which, when successively moved to the region of adjacency along the center line of the machine, create laterally opposed and aligned groups of jaw elements to form continuously moving jaw stations. Each group of jaw elements will basically include a pair of elongated, shell-like, arcuate cross sectioned jaws which are controlled by links and cam rollers and are adapted to "open" and "close" and move from a "closed" position to an "opened" position, stretching the tubes as they are moved along the central path.

In the package-making tube transfer and conveying mechanism, a successive series of discrete tubes in a lay-flat condition are fed onto a continuous conveyor which includes successive groups of fingers extending upwardly from the plane of the conveyor to receive the tubes in the generally flat condition. This tube transfer conveyor gradually opens the tubes and moves them to positions over successive jaw stations for gravity fed association with the stretching jaws.

The fourth important area of the apparatus and method involves the mechanisms for first transferring the array of containers to be packaged downwardly from the elevation of the input conveyor and then upwardly from the jaws to an output conveyor. An endless conveyor grasps successive arrays of bottles and moves them downwardly as well as along the path of movement of the jaw stations to place the array into continuously moving successive jaw stations. Each successive jaw station will have a tube in a highly stretched condition surrounding the open jaws to receive the pair of containers. The container transfer mechanism includes a similar endless conveyor to grasp the containers and move them upwardly from their appropriate jaw stations carrying with it the highly stretched tube and the thus unitized package.

INPUT-OUTPUT CONVEYOR

The conveyor section 22, as shown generally in FIG. 1, includes both input and output, continuously moving, belt-type conveyors 34 and 36, respectively.

The input conveyor section 34 includes a pair of substantially identical, laterally spaced belts located at an elevation consistent with the elevation of the filling and conveying lines in a bottling plant. Each of the two conveyors 34 is bordered by a pair of side rails 42. Each pair of side rails is spaced a distance which generally corresponds to the diameter of the bottles to be packaged, so the bottles are stabilized vertically as they are moved along the conveyor path.

The input conveyor 34 should be driven at least equal to the speed of the containers issuing from the container filling and closing equipment to avoid impeding the operation of the filling and closing equipment.

Each of the conveyors 34 and 36 will be of an endless belt variety driven by a suitable mechanism (not shown), such as chain sprocket drive mechanisms or the like. The conveyors 34 and 36 may either be directly attached to the container filling and closing equipment or form part of the carrier applicating equipment, whichever the case.

A pair of shorter length, faster moving conveyors 35 are positioned laterally inside of the input conveyors 34 in the region where the rails 42 merge inwardly toward the center line of the machine. At the point of mergence, the bottles will be in a side-by-side position controlled by a pair of idling star wheels 38 and wedge-like guide and support side surface members 40 essentially extending the innermost side rails to merge at an apex adjacent the star wheels. The pairs of bottles are continuously moved into an elevation transfer mechanism which, in the preferred embodiment, includes a handle associating mechanism 30 which places a rigid handle 20 having C-shaped extremities between each bottle beneath a radially extending rim 15 of each adjacent bottle 14. This handle supplying mechanism will be described later herein. Subsequent to the package making process, which occurs at a level beneath the conveyors, the pair of package bottles are transferred back up to the elevation of the conveyors and onto the continuously moving output conveyor 36 which is preferably at the same elevation as input conveyors 34.

PACKAGE MAKING JAW STATIONS

While the conveyor sections 22 are located at a first upper elevation, the package making jaw section 24 is located at a lower elevation, as shown generally in FIG. 1. The package making jaw section will be described in more detail with reference to FIGS. 4, 5 and 6.

The package making section 24 comprises a pair of identical endless conveyor-like sections 48, each having a plurality of equally spaced groups of jaw elements 49 secured thereto with each group comprising a pair of shell-like stretching jaws 50. Since each conveyor 48 is substantially identical only one such conveyor will be described in detail. The conveyors 48 continuously rotate along closed paths beneath the input and output conveyors and are preferably driven by coacting sprocket and drive chains 60 and 62, respectively. The closed paths of the conveyors 48 are arranged so that portions of their paths of travel are closely adjacent and opposing one another, creating a package making path extending generally longitudinally of the apparatus.

Figures 4, 5, 6, 7:
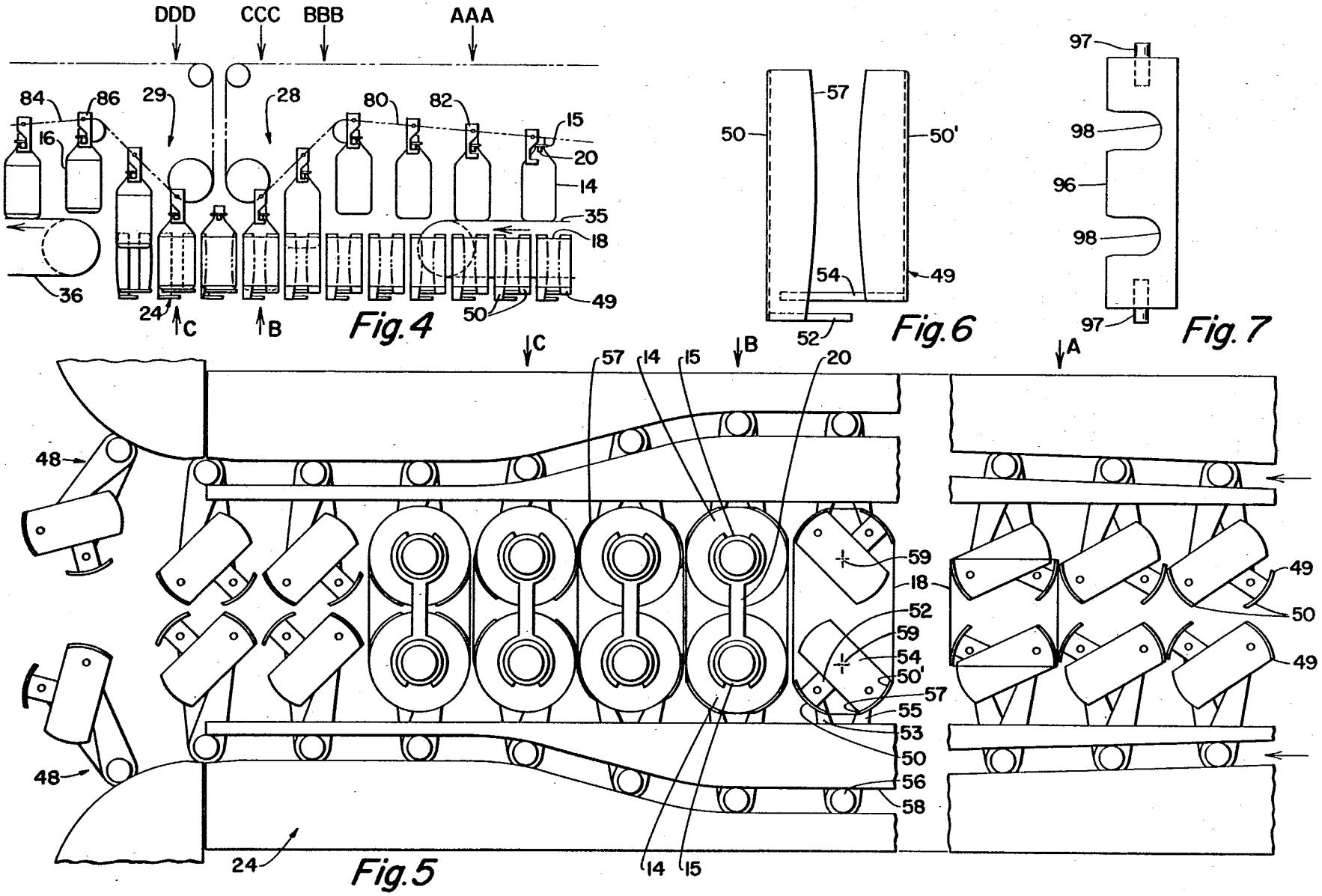
FIG. 4 is a schematic side elevation of the machine.
FIG. 5 is a top plan view directly above the jaw stations of the machine as taken in the direction of lines 4—4 of FIG. 2
FIG. 6 is an enlarged elevational view of one of the jaws used in the invention.
FIG. 7 is a fragmentary top plan view of a bottle transfer conveyor bar in a modified embodiment of the invention.

As shown in FIG. 5, each pair of jaws 50, in successive groups 49, is designed to "open" and "close" when moving in the direction of the arrows of FIG. 5, which movement is consistent in direction to the movement of the bottles and conveyors 34 and 36 as indicated by the arrow in FIG. 1. The groups will be in "closed", "open" and then "closed" conditions, respectively, at longitudinal positions A, B and C, respectively, along the package making path shown in FIG. 5. Position A is below the input conveyors 34 and more particularly, directly beneath the tube transfer and conveying system 26. Position B is directly beneath the elevation transfer mechanism 28. The "closed" condition at position C occurs after the bottles are inserted and prior to the removal of the package from the package making section 24 which is just prior to the longitudinal position of the beginning of the output conveyor 36.

It is important to recognize that the thus created jaw stations are continuously moving at a fixed rate at the elevation beneath the elevation of the input and output conveyors.

In their "closed" condition at position A, the jaw stations present the minimum lateral dimension between groups 49 of jaw elements 50, permitting a succession of tube devices 18 to be placed around each of a succession of jaw stations formed by laterally aligned pairs of groups 49 by the tube, feed and transfer station 26.

In their "open" condition at B, the jaw stations present a maximum lateral dimension between groups 49 of jaws 50, causing the tube device 18 to be carefully highly stretched while presenting a cavity defined by the jaws and the tube which permit the entry of a pair of bottles to be packaged.

When the jaw stations are again transformed to the "closed" condition as shown in position C, the jaw shells 50 are out of contact with the tube, thus creating no resistance to the removal of the package 16 consisting of the stretched tube around the bottles and, optionally, the handle, upwardly from the track of the package making path 24.

Figure 2:
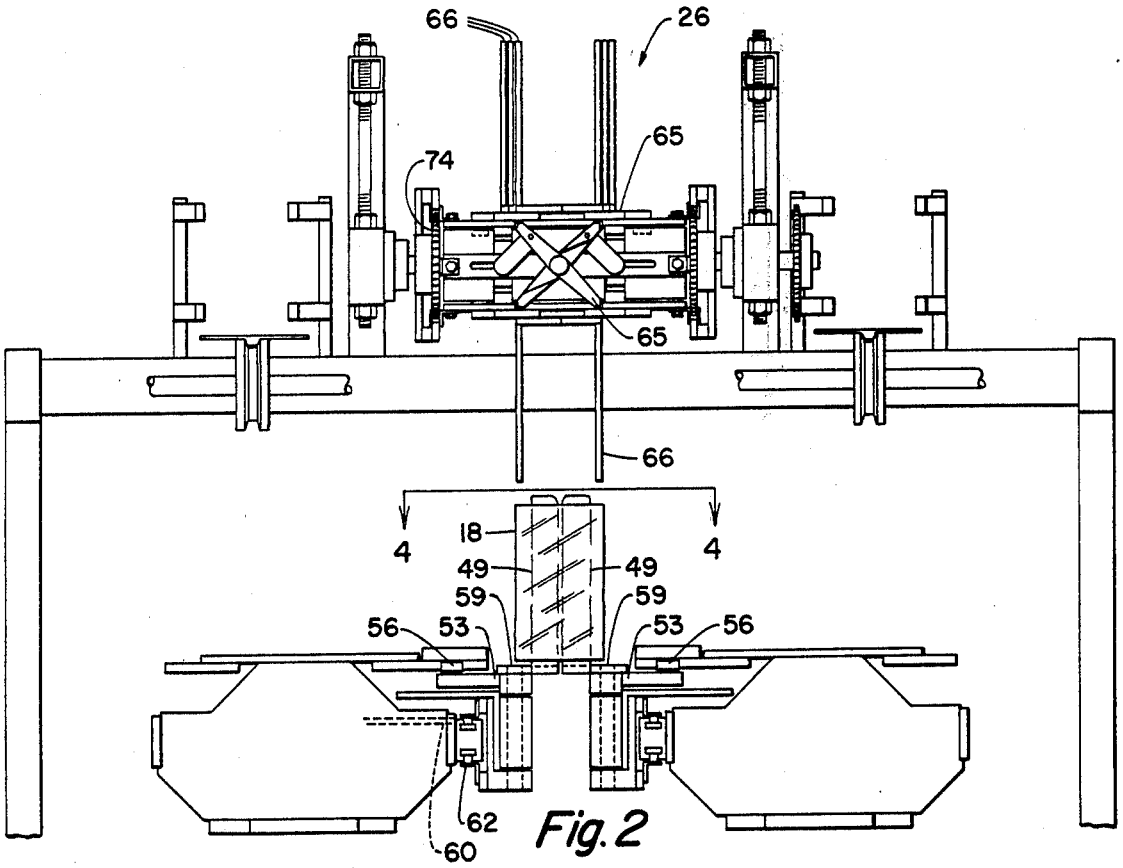
FIG. 2 is an end elevational view of the machine taken from the input extremity of the machine.

Each group 49 of jaw members is designed to provide rotational movement of the jaw shells 50 incorporated therein, about an axis generally corresponding to the longitudinal axis of a bottle to be packaged. With reference to FIGS. 5 and 6, it will be shown that one shell 50 is integrally secured to and perpendicularly upstanding from a base 52, which is in turn pivotally secured to a cam link 53. Likewise, a similar shell 50' is integrally secured to and perpendicularly upstanding from a base 54 which is pivotally secured to a cam link 55. The two cam links 53 and 55 are pivotally secured at a common axis to a cam roller 56. Bases 52 and 54 are also pivotally secured to a common pivot axis 59 which, as shown in FIG. 2, is mounted in a laterally fixed position on conveyor 48 and which axis is generally coincident with the axis of the bottle to be packaged. As the cam roller 56 is driven along the central longitudinal path of the machine, it follows a cam track 58 which pulls bases 52 and 54 and their associated shells 50 and 50' laterally outwardly away from the center line of the machine by rotating the bases about the common pivotal axis 59. The transition between the "closed" configuration as at position A, to a fully "open" configuration as at position B, preferably occurs along a long path, for example, a gradual transition over a length of the path approximating 15 to 16 stations creates an acceptable package. As the continuously moving jaw stations approach position C, which is adjacent the longitudinal position of the entry to the output conveyor 36, the cam rollers are forced inwardly by the cam track causing the jaw stations to rotate and assume a "closed" position.

It should be noted, as shown in FIG. 6, that the one longitudinal edge 57 of the jaw shell 50 is convex. The convex edge will be located on the side of the jaw which is laterally, outermost in the jaw stations when in the "open" condition as shown in position B. This edge configuration serves to prevent the highly stretched tube from riding up or moving vertically relative to the jaw stations.

TUBE FEED AND TRANSFER STATION

In order for the package making conveyors 48 to move continuously to create a package, without intermittent motion, a suitable mechanism must be provided to continuously feed a plurality of successive tubes to each successive jaw station.

Figure 3:
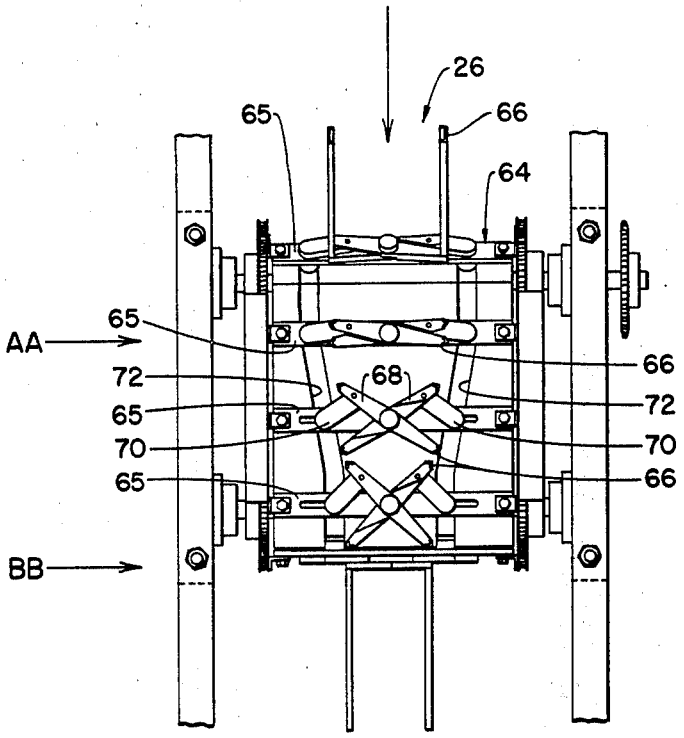
FIG. 3 is a partial top plan view of the tube package transfer area of the machine.

Accordingly, with reference to FIGS. 1, 2 and 3, it will be shown that a tube feed and transfer station 26 includes an endless belt-type conveyor 64 which is positioned over the entry portion of the package making path so as to provide for continuous feeding of such tubes to successive jaws. The endless continuous moving conveyor 64 includes a plurality of tube carrying stations 65, each consisting of four upstanding slender fingers 66 with each finger fixed to an extremity of one of a pair of interconnected cross links 68. Fingers 66 are substantially identical and are preferably L-shaped in cross section. The upper extremities of the fingers may be inclined inwardly (not shown) to more easily receive the tubes. The cross links 68 are pivotally connected to one another intermediate their finger carrying extremities.

Stations 65 continuously move through positions in which they are transformed from and to "closed" and "open" conditions. For example, in a "closed" condition as at position AA shown in FIG. 3, the fingers define tube receiving means which permit a tube in a substantially lay-flat condition to be inserted over the four fingers from a suitable feed, indexing and cutting mechanism 76 which facilitates the supply of discrete tubes 18 from a continuous roll. In the "closed" condition, the fingers 66 are at their closest position to one another relative to the direction of movement of the conveyor but at their furthest distance from one another relative to the lateral direction of the conveyor. As conveyor 64 is continuously moved by a drive and sprocket means 74 from position AA toward the entry end of the machine, the fingers 66 and their associated cross links 68 are gradually opened relative to the longitudinal direction of the conveyor. For example, in position BB, essentially where the conveyor reverses direction, the stations are in an "open" condition. The "opening" of the fingers is caused by a cam follower on each of a pair of linkages 70 adapted to move along in opposing cam tracks 72, converge on the upper level of the conveyor 64 and diverge on the lower level of the conveyor. This movement gradually forces cross links 68 toward one another so the fingers assume a box-like "open" configuration from an elongated, rectangular "closed" configuration. At "open" position BB, the linkages are essentially 90° to one another, thus being the maximum opening and permitting the tube 18 to be frictionally retained on the fingers as that particular station changes direction of longitudinal movement from the movement toward the entry end of the machine noted in FIG. 3 to a forward longitudinal movement toward the exit end of the machine which is the direction of movement of lower jaw carrying conveyor 48. Thus, at position BB and a position slightly forward of position BB, on the lower level of the conveyor in the direction of movement of the conveyor 64, the tube will not drop of its own weight even though it may be free to do so. As each station 64 approaches a position aligned directly above a jaw station created by aligned groups 49, it begins to close slightly permitting the tube to drop freely from the fingers 66 to and around jaw shells 50 in the configuration of position A in FIG. 5 and that shown also in elevation in FIG. 2.

Successive lay-flat tubes are metered and indexed onto the conveyor 64 by suitable mechanisms 92. It is again important to note that the tube feeding mechanism 26 is continuously moving to continuously feed successive tubes to the continuously moving conveyor carrying the package making jaw stations.

BOTTLE AND PACKAGE TRANSFER MECHANISM

Since the movement of the bottles and finished packages on conveyors 34 and 36, respectively, are at an elevation above the movement of the jaw station conveyor 48, a proper mechanism must be designed to continuously move the pair of bottles to be packaged down from the input conveyor to the package making section and then move the packages from the package making section upwardly to the output conveyor.

One embodiment of such transfer mechanisms is shown in FIGS. 1 and 4 as mechanisms 28 and 29, respectively, for the downward transfer mechanism and the upward transfer mechanism. In this embodiment of the invention, the packages include a rigid handle positioned between the bottles adjacent the necks and beneath the enlarged radial rim 15 near the cap of the bottles.

In such an embodiment, therefore, the handle serves as an integral portion of the transfer mechanism in cooperation with a pair of substantially similar endless chain conveyors 80 and 84 in mechanisms 28 and 29, respectively.

The first chain conveyor 80 includes a plurality of spaced hooks 82 which are moving in the direction of movement and generally at the speed of the input conveyor 34. The hooks 82 are positioned so openings face the entry end of the machine so that the bottles with handles 20 lodged therebetween may be driven into the successive hooks as at position AAA of FIG. 4. The chain and hooks change elevation slightly to lift the bottles from the conveyor and then downwardly and longitudinally of the machine as shown in position BBB of FIG. 4. An element of motion in the direction of the jaw conveyor 48 as the bottles are transferred down is essential so that the two bottles can be effectively mated with the cavity formed by the jaw and the tube in position CCC of conveyor 80 while conveyor 48 is continuously moving. Position CCC of conveyor 80 corresponds to position B of conveyor 48 of FIG. 5.

As noted above, a similar conveyor 84 with substantially identical hooks 86 is provided to transfer the packages upwardly out of the jaws and onto the output conveyor. However, in chain conveyor 84, the hooks are facing the direction of movement of the output conveyor or the exit end of the machine so that at position DDD of FIG. 4 end handles 20 of packages 26 may essentially be driven into hooks 86 with conveyor 84 pulling the packages up from the package making path 48.

Another feature of the machine which aids in the assembly of the packages, is the side rails 88 positioned in the downward transfer path as shown in FIG. 1. These side rails serve to laterally locate and restrain the soon to be packaged bottles from moving outwardly and ensure that the bottles 16 are not splayed or separated from one another while they are easily inserted in the package making conveyor in position B of the path of the groups of jaws.

In the embodiment shown in FIG. 1, the handles form an integral part of the transfer mechanism. In order to reliably feed a succession of handles to the package making area of the machine, the machine includes a handle feed mechanism which includes a handle supply holder 90 and handle indexing and insertion mechanism 92. The holder may be a single stack supply or a carousel supply of stacks which would permit more efficient handling of the handles 20. Each successive handle may be stripped from beneath the appropriate supply stock and carried in properly timed manner to successive pairs of bottles just prior to star wheels 38. The handle utilized in this embodiment is preferably the rigid device described in Ser. No. 47,436.

In situations where it is not desirable or necessary to include a handle in the package, an alternate transfer mechanism is necessary. For example, a series of container grasping bars 96 as shown in FIG. 7 could be substituted for hooks 82 and 86. The bars could be suspended from parallel chain elements by pins 97 and would include C-shaped bottle neck receiving recesses 98 longitudinally aligned with the path of the bottles when they are closely laterally positioned by the star wheels 38. These bars will serve to transfer bottles down and packages up without the use of handles.

It should be understood that certain modifications can be made to this apparatus and still come within the broad scope and intent of this invention. For example, vacuum assist devices could be incorporated at tube feed station 26 to slightly open the tubes so they may be more easily placed over the finger stations. It should also be apparent that packages of multiples of two's could be configured utilizing the basic teachings of this invention.

I claim:

1. An apparatus for applying a tube of flexible elastic plastic material in stretched encirclement of at least two generally cylindrical containers creating a package thereby as containers are continuously carried therethrough, said apparatus comprising a plurality of continuous series of groups of jaw elements mounted on each of a pair of continuous loops of conveyor elements, the pair of conveyor elements arranged so that portions of their closed paths of travel are closely adjacent and opposing one another, forming a package making path extending longitudinally of the apparatus, means for delivering two rows of containers to said package making path and means for delivering packages of pairs of said containers from said package making path, the jaw elements of each group on each of said conveyors formed to be movable relative to one another, wherein the jaw elements are arcuate, shell-like devices, cantilever secured to container receiving bases, the groups of jaw elements being arranged on their respective conveyor to present pairs of directly opposing, interacting groups as they pass along the package making path, the combination of directly opposing groups of jaw elements forming a series of tube applying stations adapted for continuous movement along the package making path, means for controlling the position of the jaw elements relative to each other to move opposing groups of jaw elements apart and together thus opening and closing the tube applying stations in a consecutive repeating pattern so that convex surfaces of the opposing groups of said elements face each other when in a closed position to permit unstretched tubes to be applied therearound and so that concave surfaces face each other when in an open position to accomplish the stretching of the tubes as the conveyor elements carry the groups of jaw elements continuously along the package making path, first to stretch tubes permitting an array of containers to be placed within the tube applying station and second to permit the package to be removed from the tube applying stations, means for transferring a succession of tubes in flattened condition to the tube applying stations and means to place containers within the stretched tubes carried by said opened jaw elements.

2. The apparatus of claim 1, wherein the means for controlling the position of the jaw elements includes a cam follower operatively secured to each jaw element and adapted to cooperate with cam follower guides on either side of the package making path.

3. The apparatus of claim 1, said container delivery means including means to deliver a succession of groups of containers to be packaged on a container input path above said package making path, means for transferring successive groups of containers downwardly from the container input path to said package making path so that the successive groups of containers may be placed in successive tubes stretched by successive jaw stations while the jaw stations are continuously moving longitudinally of the apparatus, said package delivery means including means to continuously remove successive packages of a plurality of containers with highly stretched tubes positioned thereabout from the package making path to a package output path positioned above said package making path.

4. The apparatus of claim 1, including means to deliver a succession of handles to positions between containers to be packaged.

5. The apparatus of claim 3, including means to deliver a succession of handles to successions of groups of containers to be packaged and placing a handle between adjacent containers in the group so the handle is axially and laterally retained relative to the group.

6. The apparatus of claim 5, wherein the means for transferring successive groups of containers downwardly from the container input path to the package making path includes an endless series of hooks, each successive hook adapted to co-act with the handle between containers and the handle thereby constituting part of the means for transferring successive groups to the package making path.

7. The apparatus of claim 5, wherein the means for continuously removing successive packages from the package making path to the package output path includes an endless series of hooks, each successive hook co-acting with the handle between the containers and the handle thereby constituting part of the means for removing said packages from the package making path.

8. The apparatus of claim 1, including conveying means to receive a succession of tubes in substantially flattened condition and to transfer these tubes, in at least partially opened condition, to successive groups of jaw elements as they are continuously moved along the package making path.

9. The apparatus of claim 8, wherein the tube conveying means is an endless belt-like conveyor extending longitudinally of the apparatus located above the beginning of the package making path of the jaw elements, the tube conveying means including a series of groups of fingers upstanding from the belt-like conveyor, means on the tube conveying means to open the fingers and close the fingers in each group in a consecutive, continuous repeating pattern, so that the fingers are substantially closed when they are directed upwardly of the apparatus to accept the tubes in substantially flattened condition and so that the fingers are substantially open when they are directed downwardly toward the package making path for transfer of each tube to a group of jaw elements while both the tube conveying means and jaw elements are continuously moving longitudinally of the apparatus.

10. The apparatus of claim 3, including two endless series of container grasping bars, each bar including two spaced neck engaging recesses on one edge thereof to associate around a portion of the neck of the bottles in the two containers to be packaged to convey the pair from one level of the apparatus to another.

* * * * *